US005417356A

United States Patent [19]

Franklin et al.

[11] Patent Number: 5,417,356

[45] Date of Patent: May 23, 1995

[54] LIQUID DISPENSING ASSEMBLY

[75] Inventors: Robert Franklin, Lake Hopatcong; Getachew Kassa, Hackensack, both of N.J.

[73] Assignee: Trans World Marketing Corp., E. Rutherford, N.J.

[21] Appl. No.: 184,026

[22] Filed: Jan. 21, 1994

[51] Int. Cl.[6] ..... B67D 5/40

[52] U.S. Cl. ..... 222/381

[58] Field of Search ..... 222/383, 381, 376, 385

[56] References Cited

U.S. PATENT DOCUMENTS

| | | | |
|---|---|---|---|
| 1,635,215 | 7/1927 | Johnson et al. | 222/381 X |
| 2,109,589 | 3/1938 | Horwitt et al. | 222/381 X |
| 2,168,493 | 8/1939 | Plews | 222/381 X |
| 2,464,030 | 3/1949 | Engstrom | 222/287 |
| 2,693,899 | 11/1954 | Trout | 222/381 X |
| 2,789,396 | 4/1957 | Jernander et al. | 222/381 X |
| 2,837,248 | 6/1958 | Steele | 222/381 X |
| 3,104,448 | 9/1963 | Morrow et al. | 222/381 X |
| 4,602,726 | 7/1986 | Goda | 222/381 X |
| 4,953,791 | 9/1990 | Tada | 222/381 X |
| 5,348,194 | 9/1994 | Mascitelli et al. | 222/381 X |

*Primary Examiner*—Andres Kashnikow
*Assistant Examiner*—Kenneth R. DeRosa

[57] ABSTRACT

A liquid dispensing assembly including a stationary nozzle, a pump mechanism including a stationary, hollow dispensing tube attached at a first end to the nozzle and at its other end to a piston, a generally cylindrical operating body disposed about the piston and cooperating with the piston and the stationary dispensing tube and a housing containing and maintaining said stationary nozzle and said pump mechanism in relation to one another, wherein the pump mechanism is actuated by moving the cylindrical operating body toward the nozzle in order to dispense a unit dose.

10 Claims, 1 Drawing Sheet

LIQUID DISPENSING ASSEMBLY

BACKGROUND OF THE INVENTION

The present invention relates to a liquid dispensing assembly, and more particularly, to a dispenser having a stationary nozzle and a pumping mechanism with a moving operating chamber.

It is well known to obtain cosmetics, soaps, lotions and various other liquids from a container by means of a pumping mechanism in which the nozzle reciprocates, such as in the conventional "soft soap" dispensers found in most households. In dispensers of this type, the nozzle is depressed in order to supply an external force on an operating tube which moves a piston within the pumping mechanism.

Prior art dispensers including stationary nozzles in combination with pumping mechanisms are also known, as witnessed by U.S. Pat. No. 2,464,030. In the 2,464,030 patent, the pump is actuated by pulling a handle cooperating with a piston away from the nozzle, which is quite cumbersome.

In the present invention, a unique assembly is provided wherein a radially extending arm is secured to the pump operating body and is pulled toward the nozzle while resting the thumb on the nozzle or housing directly in front of the nozzle.

SUMMARY OF THE INVENTION

According to the present invention, the dispensing assembly includes a nozzle which is maintained stationary via a housing and a pumping mechanism which is interconnected to the nozzle and positioned with respect to the nozzle via the housing. The pumping mechanism includes a cylindrical, hollow, operating body member which is designed to move along a piston and stationary dispensing tube, instead, the piston and tube move along the cylindrical body member. The cylindrical hollow body includes a radially extending actuating arm which is grasped by a user's fingers in order to operate the dispensing assembly.

It is an object of the invention to provide a dispensing assembly in which the nozzle remains stationary and the pump reservoir chamber moves about a piston.

Another object of the invention is to provide a pumping mechanism including a chamber and piston arrangement wherein dispensing actuation occurs when a user grasps an actuating arm secured to the chamber with his fingers and squeezes so as to pull the chamber toward the piston while resting his thumb on the front of the pump housing.

Still another object of the invention is to provide a dip tube which acts as an actuator when the pumping mechanism is in operation.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
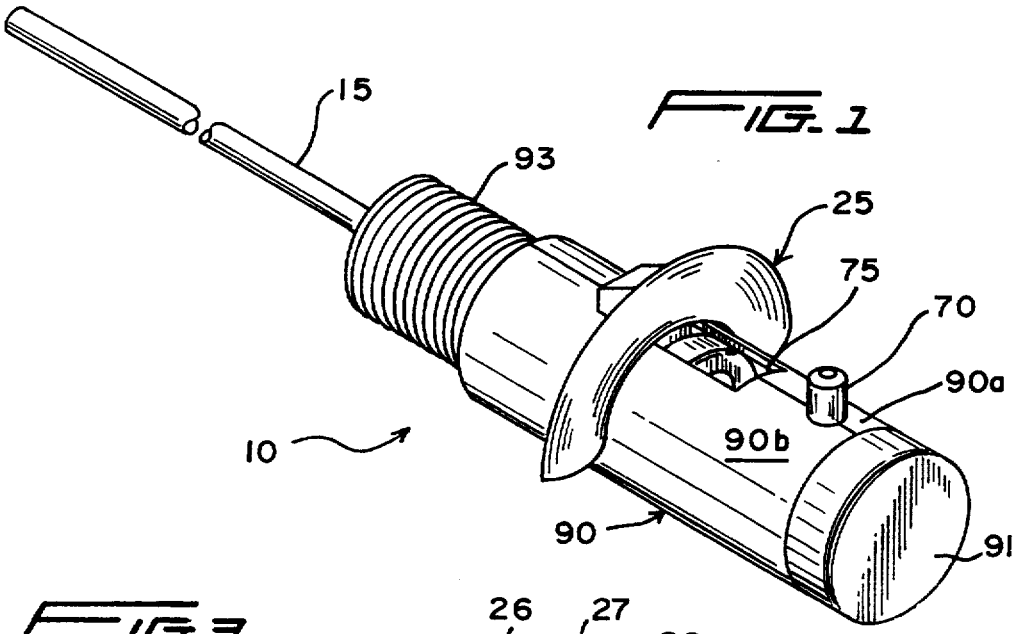
FIG. 1 is an inverted perspective view of the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Referring now to the drawings in which like-referenced numerals denote like or corresponding elements throughout the several views.

The liquid dispensing assembly of the present invention is generally designated 10 in all embodiments and includes a stationary nozzle 70, a pumping mechanism 80 and a pump and nozzle housing 90.

The pump mechanism 80 includes a hollow, generally cylindrical operating body 20, a piston 30 positioned within the cylindrical body 20, a lower ball valve 40 formed on one side of piston 30 and an upper ball valve 50 formed on the other side of piston 30, a hollow dispensing tube 60, a compression spring 35 mounted between lower valve 40 and piston 30 and a cap member 65 cooperating between cylindrical body 20 and hollow dispensing tube 60.

Figure 3:
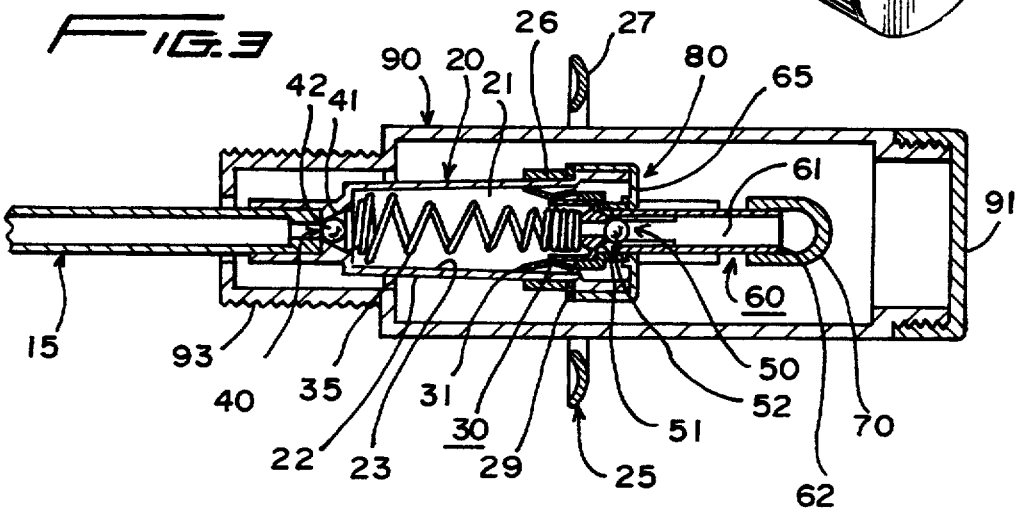
FIG. 3 is a cross-sectional view taken along front line 3,3 of FIG. 2.

Cylindrical operating body 20 having an outer wall 22 from which an actuating means 25 extends. As shown in FIG. 3, the actuating means 25 is in the form of an annular ring 26 with radially extending arms 27. The actuating means 25 may be formed with the cylindrical operating body 20 or connected thereto, such that in operation the arms 27 can be grasped by a user's fingers and pulled toward nozzle 70 in order to pump fluids from a container 95. In the present embodiment, the actuating means 25 is connected to the cylindrical operating body 20 so as to abut against a stop 29 formed in outer wall 22. An inner reservoir chamber 21 is formed by the inner walls 23 of body 20. The reservoir 21 holds the liquid before it is pumped through the flow path 61 in dispensing tube 60. Connected at the lower end of body 20 is a dip tube 15, which extends into the fluid to be dispensed. Formed at the end of the inner chamber 21 closest to the dip tube connection is a lower ball valve 40 which includes a valve seat 41 in which a ball 42 is seated.

Compression spring 35 is mounted within hollow body 20 and rests at one end upon valve seat 41. The other end of spring 35 cooperates with piston 30.

Piston 30, as shown, is annular in shape, however, other designs may be used. In the present embodiment, the piston includes a resilient outer wall 31 which cooperates with inner wall 23 of cylindrical operating body 20, as cylindrical operating body 20 is moved along stationary dispensing tube 60. Located at the side of piston 30 closest to the dispensing tube 60 is upper ball valve 50 which has a valve seat 51 formed in the piston and a ball 52 seated therein.

Stationary tube 60 includes a liquid flow path 61 in the form of a bore which runs the length of the tube. The first end 62 of the tube 60 is connected to nozzle 70 by frictionally force-fitting end 62 within a transverse bore 71 in nozzle 70.

Cap member 65 includes a through-hole in order to accommodate hollow dispensing tube 60 and engages both a portion of tube 60 and body 20 in order to secure them to one another to form a closed inner chamber 21.

Figure 4:
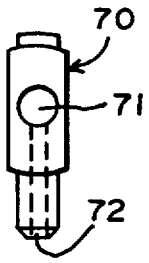
FIG. 4 is a rear view of the nozzle shown in FIG. 2, taken alone.

Nozzle 70 is maintained in a fixed position relative to pumping mechanism 80, i.e., the nozzle does not move during the pumping action. Thus, unlike the conventional cosmetic dispensing devices, one can place a container to be filled at rest under the nozzle during dispensing. Nozzle 70 is held stationary by housing 90. As seen in FIG. 4, nozzle 70 includes a transverse bore 71 and a longitudinal bore 72. Nozzle 70 can be made as a separate component, as shown, or formed integrally with housing 90 in an alternative embodiment.

Housing 90 also functions to enclose pumping mechanism 80 such that actuating arm 27 extends a sufficient distance therefrom in order that the arm 27 may be easily grasped by a user's fingers. Thus, the configuration of the housing 90 can be provided in a variety of aesthetically pleasing designs, so long as it maintains the nozzle stationary and allows access to and movement of the actuating arm 27. As can be seen in FIG. 1, arm 27 travels in a track 75 formed in the housing 90. As shown in FIG. 1, the housing can be manufactured in two halves 90*a* and 90*b* and then secured together at its rear by retainer 94 and at its front by retainer 91. Manufacturing in this manner allows for easy replacement of defective pump mechanisms.

Preferably, all of the components of the present invention are made from plastic, with the exception of the spring 35 and balls 42 and 52, which would be better made from a metal.

Figure 2:
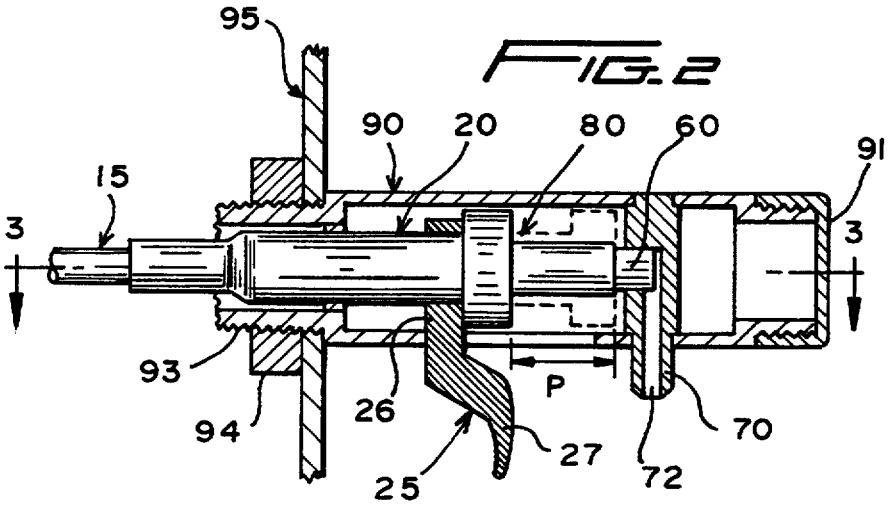
FIG. 2 is a cross-sectional view of the invention shown in FIG. 1.

In operation, as best shown in FIGS. 2 and 3, the nozzle housing 90 is mounted to surface 95 of the container containing the liquid to be dispensed. The housing may be secured by threads 93 and retainer 94 or by any suitable means. The housing 90 now renders the nozzle stationary, allowing a user to grasp arm 27 with his first two fingers and place his thumb on front surface of retainer 91. Once in this position, the user simply squeezes, thereby pulling the arm 27 toward the nozzle and dispensing a unit dose. The unit dose results when reservoir 21 is full and the cylindrical operating body 20 is displaced forward towards the nozzle along the stationary dispensing tube 60. The length of the pump stroke P is fixed, and thus only a predetermined amount of liquid can travel through path 61 and out nozzle bore 72 as cylindrical operating body 20 is moved forward.

The external force applied to arm 27 causes body 20 to move forward, which closes lower valve 40 and opens upper valve 50, thereby allowing a liquid in reservoir 21 to be forced through piston 30 into dispensing tube 60 and out nozzle 70. When the external force on arm 27 is released, spring 35 acts to push the cylindrical body rearward, forming a vacuum in reservoir 21, which opens lower valve 40 and draws more liquid in to fill the reservoir. The dip tube 15, located in the container full of liquid to be dispensed, moves with the cylindrical body 20 as it is actuated. The movement of the dip tube 15 acts as an agitator within the liquid supply and helps in preventing the pumping mechanism 80 from becoming clogged.

While various preferred embodiments have been shown and described, it will be understood that there is no intent to limit the invention by such disclosure, but rather, is intended to cover all modifications and alternate constructions falling within the spirit and scope of the invention as defined in the appended claims.

We claim:

1. A dispensing assembly comprising:

a stationary nozzle;

a pump mechanism including a stationary, hollow dispensing tube attached at a first end to said stationary nozzle and at its other end to a piston, a generally cylindrical operating body disposed about said piston cooperating with said piston and said stationary dispensing tube, and a cap member cooperating with said stationary dispensing tube and said generally cylindrical operating body to form a closed, inner fluid reservoir;

a housing containing and maintaining said stationary nozzle and said pump mechanism in a fixed relationship to one another; and, an actuating means having an arm extending radially from said generally cylindrical operating body so as to extend out of said housing in order to be grasped by a user's fingers and pulled toward said nozzle.

2. The invention of claim 1, wherein said housing includes a front surface configured to accept the thumb of a user, and thereby allows actuation to occur by squeezing the fingers and thumb toward one another.

3. The invention of claim 1, wherein a dip tube is secured to and moves with said generally cylindrical operating body, which thereby functions to agitate the liquid as it is being drawn into the inner fluid reservoir.

4. The invention of claim 1 which includes an annular ring from which said arm extends.

5. The invention of claim 1, wherein the housing is formed from two separate halves and a front and rear retainer.

6. A dispensing assembly comprising:

a stationary nozzle;

a pump mechanism including a stationary, hollow dispensing tube attached at a first end to said stationary nozzle and at its other end to a piston, a generally cylindrical operating body disposed about said piston cooperating with said piston and said stationary dispensing tube, and a cap member cooperating with said stationary dispensing tube and said generally cylindrical operating body to form a closed, inner fluid reservoir;

a housing containing and maintaining said stationary nozzle and said pump mechanism relative to one another; and, an actuating means having an arm extending radially from said generally cylindrical operating body so as to extend out of said housing and moves toward said nozzle in order to dispense.

7. The invention of claim 6, wherein said housing includes a front surface which is generally parallel to the dispensing direction of the nozzle.

8. The invention of claim 6, wherein said nozzle is attached to said dispensing tube at an angle.

9. The invention of claim 7, wherein said arm moves toward said housing front surface during dispensing.

10. The invention of claim 6, wherein the housing is formed from two separate halves which are joined by a front and rear retainer.

* * * * *